United States Patent [19]

Carse

[11] 4,076,148

[45] Feb. 28, 1978

[54] MULTIPLE FLUID DISPENSER WITH MECHANICAL VALVE

[76] Inventor: Clifford C. Carse, 500 Woodcrest Court, Boulder City, Nev. 89005

[21] Appl. No.: 732,020

[22] Filed: Oct. 13, 1976

[51] Int. Cl.[2] ..... B67D 5/60

[52] U.S. Cl. ..... 222/144.5; 222/145; 239/305

[58] Field of Search ..... 222/145, 144.5, 129.1, 222/493, 496; 239/304, 305, 414; 137/516.11

[56] References Cited

U.S. PATENT DOCUMENTS

| | | | |
|---|---|---|---|
| 1,184,031 | 5/1916 | Schneible | 222/144.5 X |
| 3,664,552 | 5/1972 | Carse | 222/144.5 |
| 3,717,284 | 2/1973 | Garrard | 222/129.1 |
| 3,908,868 | 9/1975 | Peirish | 222/145 |

*Primary Examiner*—John J. Love

*Attorney, Agent, or Firm*—Romney, Schaap, Golant, Scillieri, Disner & Ashen

[57] ABSTRACT

A multi-fluid dispensing apparatus having a plurality of conduits which terminate at a flat surface. A reciprocally movable piston valve having a flat surface which is large enough to abut the conduit terminal flat surface for closing all of the conduits and is movable within the housing between open and closed (abutting) positions. The flat surface of the piston valve includes a discharge for directing liquid against an interior wall to slow flow rate. A variation of the piston valve includes a circumferential slot whereby gas may be sucked into the liquid stream and to promote mixing.

3 Claims, 7 Drawing Figures

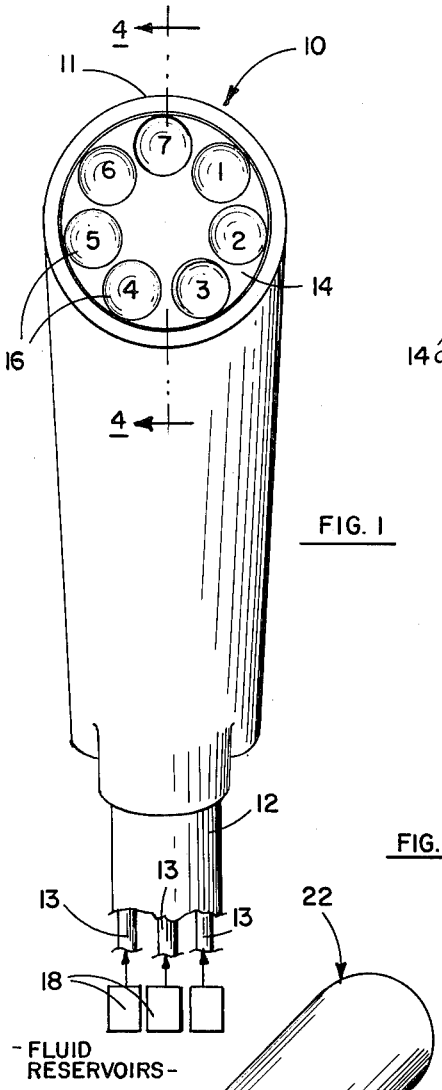
FIG. 1
FIG. 5
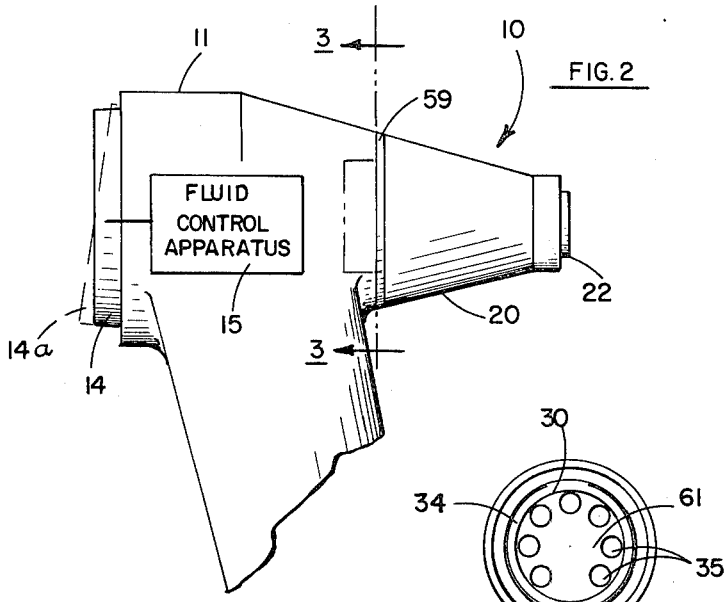
FIG. 2
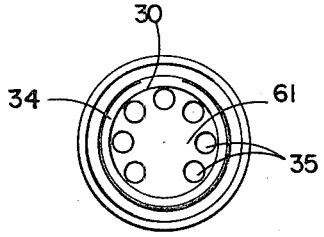
FIG. 3
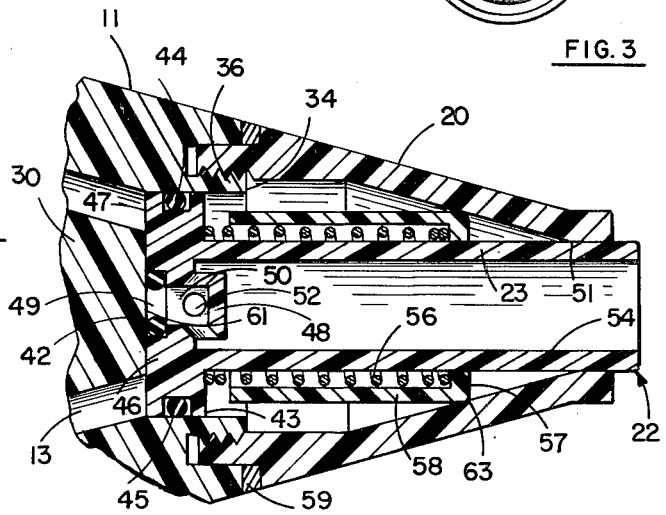
FIG. 4
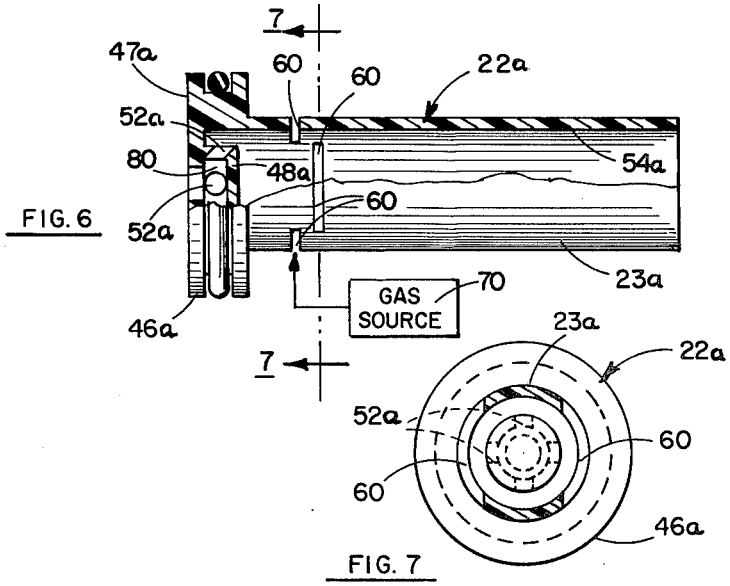
FIG. 6
FIG. 7

MULTIPLE FLUID DISPENSER WITH MECHANICAL VALVE

BACKGROUND OF THE INVENTION

1. Field of the Invention

The present invention relates to fluid dispensing mechanical valves and, more particularly, to a mechanical valve for controlling the flow of a plurality of fluids in a single housing such as those used in the food service industry.

2. Description of the Prior Art

Multiple fluid dispensing units are connected to a plurality of fluid reservoirs by a plurality of fluid conduits. In the past, such dispensing units contained a plurality of valves, each valve controlling the fluid flow of a single fluid in its corresponding conduit. The prior art dispensing units were consequently large, bulky and heavy due to the number of components contained within the dispenser housing. They were also exceedingly cumbersome and awkward to use.

In the prior art devices, individual valves were used for each conduit; the valves were small and susceptible to fluid leakage. Leakage was extremely common if the fluid dispensing housing which contained the valves was vibrated or suffered a shock such as when it was dropped. Even in normal usage leakage occurred when the housing was shaken. The fluid leakage may not only be expensive if the fluid is an alcoholic beverage but unsanitary; leakage on a serving counter, or other working surface, on which the dispenser is used may become sticky and unsightly and thus required frequent cleansing or it becomes a health hazard.

Also, in the prior art devices, since the valves were small, it was possible for the operator of the device to extract fluid by sucking on the nozzle of the fluid dispensing head. Once again if the fluids were relatively expensive, such as alcoholic beverages, the monetary value of lost fluid can become quite high.

Another disadvantage of prior art devices was the difficulty encountered in cleaning the internal components. In many applications, such as the dispensing of soft drinks, the internal parts become sticky and gummy and must be cleaned frequently to insure proper operation. This was difficult and quite time consuming in units having a plurality of small valves.

Many times, in prior art devices, the flow rate of the fluid upon being expelled from the nozzle into the desired receptacle was too high and the fluid splashed out of the receptacle; on some occasions the flow rate was so high that the fluid followed the interior contour of the receptacle, traveling in and then out and was completely lost.

In situations where carbonated fluid, such as water, was required, it was necessary in prior art devices to carbonate the water and place it in a holding tank prior to use. If the carbonated fluid was not used within a predetermined period of time, it tended to become flat and thus unusable.

SUMMARY AND OBJECTS OF THE INVENTION

The above-mentioned problems of the prior art devices have been overcome by the present invention which provides a single mechanical valve for controlling the flow of fluids in a plurality of fluid conduits.

A general object of the invention is to provide a multiple fluid dispensing unit having a single mechanical valve which may be used for controlling the fluid flow.

Another object of the invention is to provide a multiple fluid dispensing unit with a single mechanical valve for controlling the fluid flow rate of a plurality of fluids which will not leak during normal use or when subjected to normal shock or vibration.

Still another object of the invention is to provide a multiple fluid dispensing unit with a single mechanical valve which is simply constructed, economical to produce, and easy to operate.

Yet another object of the invention is to provide a multiple fluid dispensing unit with a single mechanical valve which will provide for a choice of fluids from among a plurality of fluids and which will produce an output flow rate which will be substantially slower than the flow rate in the fluid conduits preceeding the valve.

Still another object of the invention is to provide a single mechanical valve for a multiple fluid dispensing unit which will allow a gas to be mixed with a fluid in the dispenser housing prior to expulsion.

Other objects and advantages of the invention will appear from the following description taken in conjunction with the accompanying drawings of an illustrated embodiment of the invention.

BRIEF DESCRIPTION OF THE DRAWINGS

FIG. 1 is a rear elevation view of a multiple fluid dispenser housing connected to a flexible sheath umbilical cord;

FIG. 2 is a side elevational view of the nozzle and touch plate portions of the fluid dispenser housing;

FIG. 3 is an end elevational view taken along line 3—3 of FIG. 2;

FIG. 4 is a fragmentary enlarged cross-sectional view taken along line 4—4 of FIG. 1;

FIG. 5 is an isometric projection of a piston valve element;

FIG. 6 is a side elevational view; partially in cross-section of a modified piston valve element; and FIG. 7 is a cross-sectional view taken along line 7—7 of FIG. 6.

DESCRIPTION OF THE PREFERRED EMBODIMENTS

While the present invention is susceptible to various modifications and alternative constructions, illustrative embodiments are shown in the drawing and will be described in detail hereinbelow. It should be understood, however, that it is not the intention to limit the invention to the particular forms disclosed; but, on the contrary, the invention is to cover all modifications, equivalences and alternative constructions falling within the spirit and scope of the invention as expressed in the appended claims.

Referring initially to FIGS. 1 and 2, there is disclosed a hand held multiple fluid dispenser 10 having a housing 11 attached to a flexible sheath umbilical cord 12. The ubmilical cord 12 contains a plurality of fluid conduits 13 which transfer fluids from a plurality of fluid reservoirs 18 to the dispenser 10. Mounted to the forward portion of the dispenser housing is a touch plate 14. The touch plate 14 has a plurality of numbered convex depressions 16 in a circular arrangement. By depressing the touch plate at one of the depressions 16 (shown in FIG. 2 in dotted lines and designated **14*a*), a fluid control apparatus 15 for the fluid dispenser is activated and a predetermined amount of fluid will be fed into the fluid conduit corresponding to the numbered depression which was operated. The fluid control apparatus for the fluid dispenser is of a type well known in the art such as that disclosed in my U.S. Pat. No. 3,664,552, which issued May 23, 1972. In the forward portion of the fluid dispenser housing 11 is a nozzle 20 and a piston valve 22** through which the expelled fluid will pass.

Referring now to FIG. 3, there is shown within the fluid dispenser housing 11 a threaded lip 34 and a discharge neck 30. The discharge neck 30 has a plurality of fluid conduit termination ports 35 which are the down stream terminals of the fluid conduits 13. Upstream of the discharge neck, each fluid is kept within a preselected fluid conduit, separate and apart from all other fluids which is also enclosed in separate fluid conduits. Thus, there is no mixing of the fluids in the fluid conduit system and the fluids may be transferred from their respective fluid reservoirs to the discharge neck without being contaminated.

Referring now to FIGS. 3, 4 and 5, the discharge neck is shown to have a plurality of fluid conduits 35 and a flat port surface 61. The nozzle 20 of the dispenser housing has a tapered shape and includes a tapered washer 59. Within the nozzle is the piston valve 22, a valve biasing spring 56, and a spring sleeve 58. The fluid conduits terminate at the flat port surface 61. The piston valve 22 has a hollow stem portion 23 and a head portion 46 having an end surface 47 which mates with the flat port surface 61. Thus when the flat port surface abuts the head end surface all of the fluid conduits 13 are blocked or closed. An annular seal groove 45 encircles the head portion 46. A seal 44 is seated within the seal groove 45 to prevent leakage of fluid into the region between the piston valve and an inner surface 51 of the nozzle.

Engaging the threaded lip 34 is a corresponding threaded end of the tapered nozzle 20. The tapered washer 59 prevents rotation of the nozzle relative to the housing during use. The interior surface 51 of the tapered nozzle abuts the down stream end of the piston valve stem portion 23 forming a stable support structure for the stem portion and allowing reciprocal motion. The valve biasing spring 56 encircles the stem portion in a slightly compressed condition and one end abuts a lower flange surface 43 of the piston valve head. The opposite end of the spring abuts an inwardly directed flange 57 of the spring sleeve 58 which encircles the spring. Normally, the spring biases the piston valve to a closed position in which the flat port surface 61 and the head end surface 47 abut. However, if sufficient pressure exists in one of the fluid conduits the piston valve is moved away from the discharge neck to an open position. An end portion 63 of the outer surface of the spring sleeve abuts the inner surface of the nozzle and is retained in place.

Referring now to FIGS. 4 and 5, the piston valve head 46 has a centrally located discharge opening 48 including an enlarged annular recess 49, in which a seal 42 is seated, and a smaller annular recess 50. Dispersion openings 52 are formed in a cup whereby fluid entering the intake cup is channeled in a direction almost perpendicular to the direction of the longitudinal axis of the piston valve and against the interior wall 54 of the stem.

Now referring to the drawings generally, the operation of an exemplary form of the device will be explained. In the preferred initial operating mode, each fluid conduit is filled with a different fluid which communicates with, or more specifically, is fluidically connected to a fluid reservoir. The apparatus is actuated by the operator depressing the touch plate at one of the depressions 16. Such an action will cause the touch plate to tilt (as shown in dashed line, FIG. 2). The fluid control apparatus will cause fluid to be fed into one of the fluid conduits 13. There will be a corresponding increase in fluid pressure in this fluid conduit which will force the piston valve to be moved or displaced from the discharge neck and further compressing the valve biasing spring, until the force acting on the end surface 47 of the piston valve is equal to the force exerted by the spring. Fluid will then flow into the space between the flat port surface 61 and the head end surface 47. During normal operation, all fluid conduits 13 will contain a fluid. Since only the pressure in one fluid conduit will be increased, and all other fluid conduits will be filled, no fluid from the activated fluid conduit will enter or mix with the fluid in another conduit. The fluid which is under pressure will flow through the centrally located discharge opening and into the recess 50 and then out the dispersion openings 52 in a direction generally perpendicular to the longitudinal axis of the stem portion 23. The fluid will strike the interior wall 54 of the stem and turbulently flow along the interior of the stem into the desired receptacle at a relatively low flow rate. The discharge opening has the advantage of decreasing the fluid flow rate and eliminating unwanted splashing of the fluid upon entering the desired receptacle such as a glass.

When a predetermined quantity of fluid has been provided, the fluid control apparatus will cease feeding fluid into the fluid conduit. When this occurs, the fluid pressure between the discharge neck and the piston valve will decrease as the fluid passes through the discharge opening. The spring which is under compression will then force the head end surface 47 into abuttment with the flat port surface 61 to positively close all further flow of fluid. Thus a major advantage is achieved by having a single relatively large valve, i.e. the head portion of the stem, close off a number of small fluid conduits with a relatively large force supplied by the single large spring. This may be compared to the prior art in which a number of valve stems were provided one for each conduit. Because of the small size of the stem and related spring as well as small seals, leakage was a major problem. The present inventive apparatus uses one large valve and only one realtively large seal. An additional advantage is the common discharge arrangement. This allows a more compact, less complicated unit and there allows cost savings. Furthermore, the larger stem size provides for a more desirable flow pattern, very much like that from a bottle.

The dispenser may be easily cleaned by unscrewing the nozzle from the dispenser housing. The spring sleeve, the spring and the piston valve may then be easily and quickly removed, cleaned and reassembled. Such a feature is exceedingly important in the food service industry where cleanliness and rapid service of patrons is a requirement.

Now referring generally to FIGS. 6 and 7, there is shown a modified piston valve **22*a*, having a head portion 46*a* with a flat end surface 47*a* and a stem portion 23*a*. A discharge opening 48*a* having an annular recess 80 and dispersion openings 52*a* is disposed within the head portion. A plurality of gas intake slots 60 are disposed laterally along the circumference of the stem portion. In the preferred embodiment, these slots are symmetrically spaced so that there is an effective opening for the complete circumference of the stem portion. The piston valve 22a is connected with the fluid dispenser housing, a biasing spring and a spring sleeve as previously indicated with regard to the post 22, FIG. 4. However, a gas output source 70 is provided in the vicinity of the gas intake slots. When a carbonated drink is desired the operator depresses the proper depression. Another valve (not shown) opens to communicate gas and the outside of the stem. As the fluid turbulently flows along the inner surface 54a of the stem portion, this gas is sucked through the slots 60** by venturi action and mixes with the fluid.

For example, if the gas is carbon dioxide and the fluid is water, the mixing of the water and the carbon dioxide in the post stem is an excellent and inexpensive manner of producing carbonated water for use at soda fountains and the like.

The modified piston valve 22a has been shown without an inner seal at the central recess such as the seal 42, FIG. 4. I have found that while a seal in this location, to prevent leakage into the intake cup, is desirable, it may be removed provided the closing force exerted by the biasing spring is sufficiently large.

It will therefore be appreciated by those skilled in the art that a single mechanical valve for controlling a plurality of fluid conduits having the aforementioned characteristics can be easily constructed at a relatively inexpensive cost and will operate in a manner superior to presently existing systems.

What is claimed is:

1. A dispensing apparatus comprising:

a housing having a flat discharge surface;

a nozzle connected to said housing and having a converging inner surface;

a plurality of conduits formed in said housing, each conduit communicating with a corresponding fluid reservoir, said conduits terminating at said flat discharge surface;

a linearly movable piston valve element mounted to slide within said nozzle, said piston having a head portion including a flat surface for abutting said flat discharge surface to open and close said conduits to the passage of fluid, and a tubular stem portion extending through said nozzle to direct the discharge of said fluid from said apparatus, said head portion having a centrally located recess with radially spaced openings for directing fluid radially against an interior wall of said tubular stem; and a compression spring disposed around an exterior wall of said tubular stem and out of contact with the flow of fluid, said spring biasing said piston element against said flat discharge surface whereby said piston element is slidable in response to pressure variations in the fluid conduits and the biasing force created by said spring.

2. An apparatus as claimed in claim 1 including:

a spring retaining sleeve disposed about said stem portion and having an end portion for abutting said nozzle inner surface and an annular flange for restraining said spring, said piston element being slidable relative to said sleeve.

3. An apparatus as claimed in claim 2 including:

an opening in said stem portion for communicating said stem interior with the environment about said stem exterior whereby the flow of fluid creates a pressure differential for moving another fluid from exterior of said stem portion to the interior of said stem portion.

* * * * *